US012017882B2

(12) United States Patent
Umi

(10) Patent No.: US 12,017,882 B2
(45) Date of Patent: Jun. 25, 2024

(54) MEDIUM CONVEYING APPARATUS IN WHICH SEPARATION FORCE OF SEPARATION ROLLER BY GEAR WITH RESPECT TO PRESSING FORCE OF SEPARATION ROLLER BY TORQUE LIMITER IS SET APPROPRIATELY

(71) Applicant: PFU LIMITED, Kahoku (JP)

(72) Inventor: Takayuki Umi, Kahoku (JP)

(73) Assignee: PFU LIMITED, Kahoku (JP)

( * ) Notice: Subject to any disclaimer, the term of this patent is extended or adjusted under 35 U.S.C. 154(b) by 169 days.

(21) Appl. No.: 17/450,239

(22) Filed: Oct. 7, 2021

(65) Prior Publication Data

US 2022/0169463 A1 Jun. 2, 2022

(30) Foreign Application Priority Data

Nov. 30, 2020 (JP) ..... 2020-198717

(51) Int. Cl.
*B65H 3/06* (2006.01)
*B65H 5/06* (2006.01)
*B65H 5/38* (2006.01)

(52) U.S. Cl.
CPC ..... *B65H 5/062* (2013.01); *B65H 3/063* (2013.01); *B65H 5/38* (2013.01); *B65H 2403/40* (2013.01); *B65H 2403/422* (2013.01); *B65H 2403/732* (2013.01); *B65H 2404/1521* (2013.01); *B65H 2404/166* (2013.01); *B65H 2801/39* (2013.01)

(58) Field of Classification Search
CPC .. B65H 3/063; B65H 3/5284; B65H 2403/40; B65H 2403/732
See application file for complete search history.

(56) References Cited

U.S. PATENT DOCUMENTS

| | | | | |
|---|---|---|---|---|
| 9,637,333 | B2 * | 5/2017 | Kuriki | B65H 3/0669 |
| 11,111,093 | B2 * | 9/2021 | Ichikawa | B65H 5/062 |
| 11,208,279 | B2 * | 12/2021 | Umi | B65H 9/20 |
| 11,472,649 | B2 * | 10/2022 | Umi | B65H 7/12 |

FOREIGN PATENT DOCUMENTS

| | | |
|---|---|---|
| JP | 2002-249250 A | 9/2002 |
| JP | 2012-166926 A | 9/2012 |

* cited by examiner

*Primary Examiner* — Patrick Cicchino
(74) *Attorney, Agent, or Firm* — LEWIS ROCA ROTHGERBER CHRISTIE LLP

(57) ABSTRACT

A medium conveying apparatus includes a torque limiter provided on a rotation axis of the separation roller, a unit including a first gear, a second gear provided on the rotation axis, and a third gear provided between the first gear and the second gear. The separation roller is pressed toward a feed roller side by a force generated by the torque limiter. The first gear rotates in a direction for generating a force for separating the separation roller from the feed roller. The third gear is a two-stage gear. The number of teeth of a gear on the second gear side of the third gear is more than the number of teeth of a gear on the first gear side of the third gear.

4 Claims, 13 Drawing Sheets

MEDIUM CONVEYING APPARATUS IN WHICH SEPARATION FORCE OF SEPARATION ROLLER BY GEAR WITH RESPECT TO PRESSING FORCE OF SEPARATION ROLLER BY TORQUE LIMITER IS SET APPROPRIATELY

CROSS-REFERENCE TO RELATED APPLICATIONS

This application is based upon and claims the benefit of priority of prior Japanese Patent Application No. 2020-198717, filed on Nov. 30, 2020, the entire contents of which are incorporated herein by reference.

TECHNICAL FIELD

Embodiments discussed in the present specification relate to medium conveyance.

BACKGROUND

Recently, the medium conveying apparatus to separate and feed a medium is required to convey not only a paper but also a medium having a thickness such as a passport, as a medium.

A feeding apparatus for acquiring a rotation of a conveying direction and a rotation of a return direction of a reverse roller with respect to a sheet-shaped medium by a change of a frictional force according to the number of the sheet-shaped medium entering a nip portion of a feed roller and the reverse roller is disclosed (see Japanese Unexamined Patent Application Publication (Kokai) No. 2002-249250). The feeding apparatus has a configuration in which a nip pressure of the nip portion of the feed roller and the reverse roller varies, and a feeding driving time in a state in which the nip pressure is the lowest is set to be larger than a time in which a fixed point of the sheet-shaped medium passes through the nip portion.

A sheet conveying apparatus supporting a retard roller rotatably on a rotary support axis, and provided with a locking claw at one end of the rotary support axis, and a lever for swinging the locking claw is disclosed (see Japanese Unexamined Patent Application Publication (Kokai) No. 2012-166926). In this sheet conveying apparatus, a retard roller holder supported by an apparatus main body is provided with a locked portion with which the locking claw is engaged, and the retard roller is detachable from the apparatus main body by operating the lever.

SUMMARY

According to some embodiments, a medium conveying apparatus includes a feed roller to feed a medium, a separation roller located to face the feed roller to separate the medium, a torque limiter provided on a rotation axis of the separation roller, a motor to generate a driving force for rotating the separation roller in a direction opposite to a medium feeding direction, a unit including a first gear to rotate according to a driving force generated by the motor, a second gear provided on the rotation axis of the separation roller, and a third gear provided between the first gear and the second gear, wherein the unit is supported swingably with an axis of the first gear as a rotation axis. The separation roller is pressed toward the feed roller side by a force generated by the torque limiter limiting a torque with which the separation roller attempts to rotate in a direction opposite to a rotation direction of the feed roller. The first gear rotates in a direction for generating a force for separating the separation roller from the feed roller by rotation of the motor. The third gear is a two-stage gear. The number of teeth of a gear on the second gear side of the third gear is more than the number of teeth of a gear on the first gear side of the third gear.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
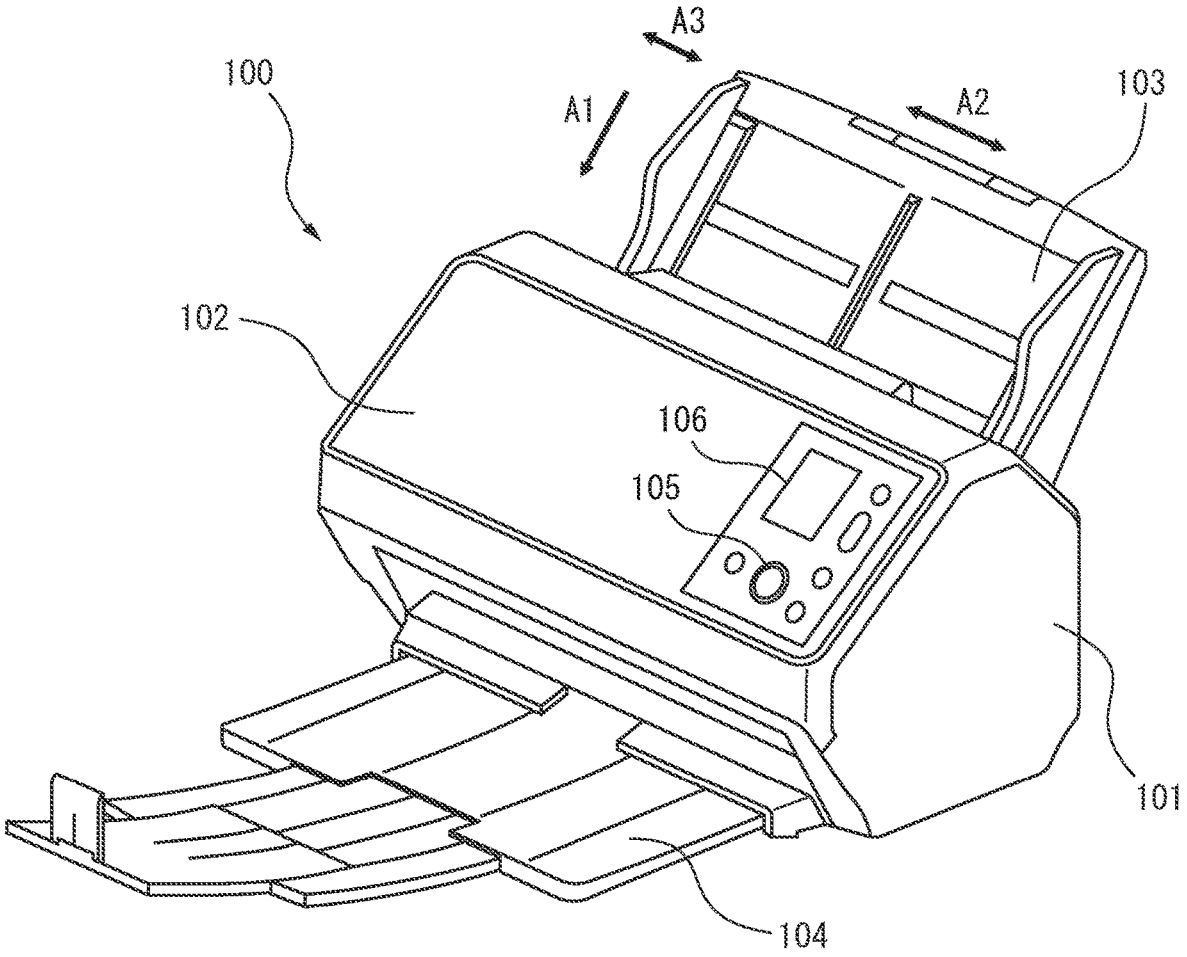
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. A medium is a paper, a thin paper, a thick paper, a card, a brochure, a brochure, a passport, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106. An arrow A1 in FIG. 1 indicates a medium conveying direction. An upstream hereinafter refers to an upstream in the medium conveying direction A1, and a downstream refers to a downstream in the medium conveying direction A1. An arrow A2 indicates a width direction perpendicular to the medium conveying direction A1. An arrow A3 indicates a height direction A3 perpendicular to a medium conveying surface.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc. The medium tray 103 is engaged with the lower housing 101 in such a way as to be able to place a conveyed medium. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
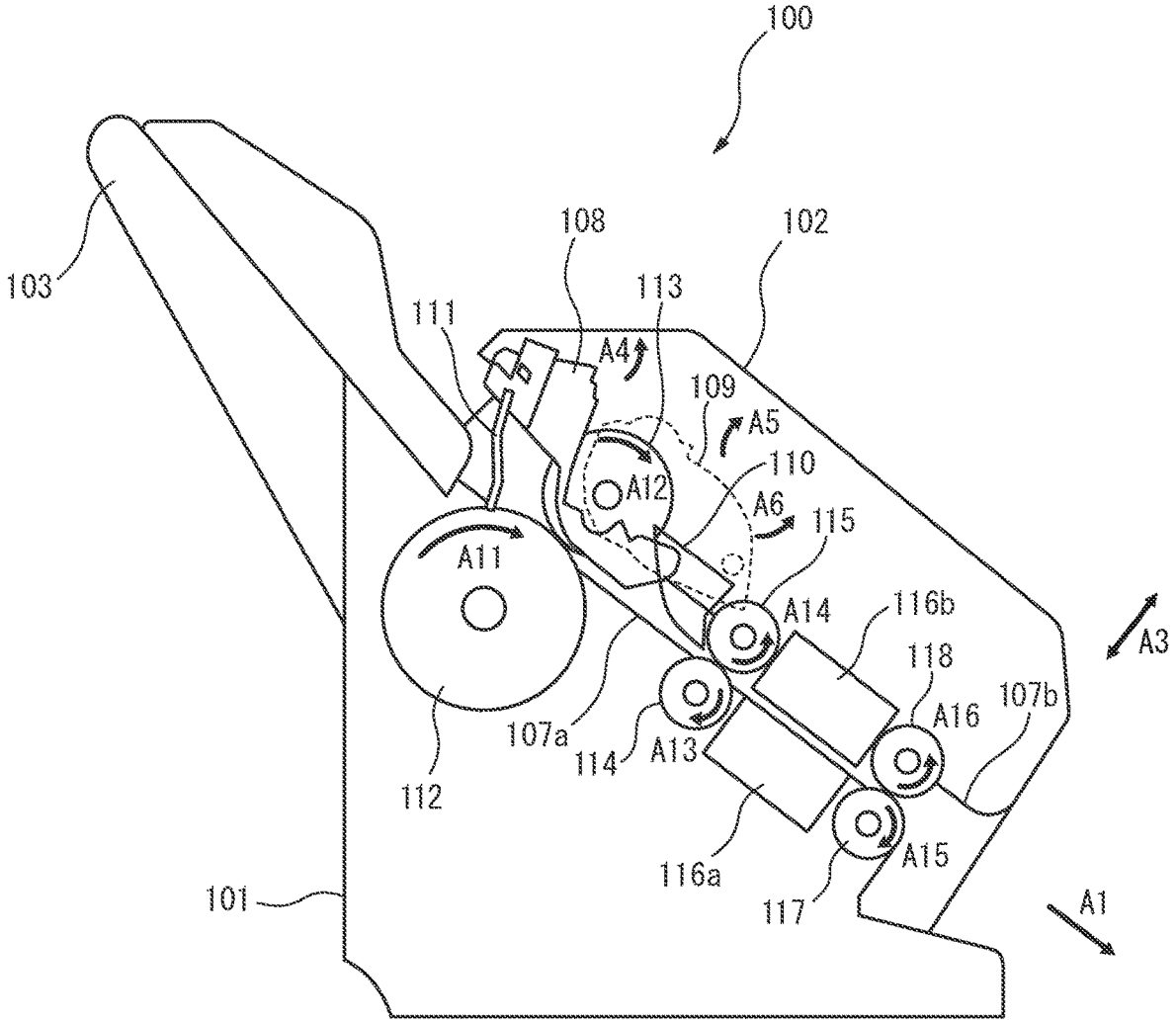
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a first guide 108, a support member 109, a second guide 110, a medium sensor 111, a feed roller 112, a brake roller 113, a first conveyance roller 114, a second conveyance roller 115, a first imaging device 116*a*, a second imaging device 116*b*, a first ejection roller 117 and a second ejection roller 118, etc. The numbers of each roller is not limited to one, and may be plural.

A top surface of the lower housing 101 forms a lower guide 107*a* of a conveyance path of a medium, and a bottom surface of the upper housing 102 forms an upper guide 107*b* of the conveyance path of a medium. The lower guide 107*a* and the upper guide 107*b* are examples of a conveyance guide to guide the medium. The upper guide 107*b* includes the first guide 108 and the second guide 110, etc. The support member 109 is located on an opposite side of the feed roller 112 with the upper guide 107*b* in between, i.e. above the upper guide 107*b* in the height direction A3.

The first guide 108 is provided at a position overlapping the feed roller 112 and the brake roller 113 in the medium conveying direction A1. The first guide 108 is supported by the upper housing 102 so that a downstream end portion thereof swings upward (in a direction of an arrow A4 in FIG. 2) according to a thickness of the conveyed medium. The first guide 108 is in contact with a front end of the medium entering a nip position of the feed roller 112 and the brake roller 113 to regulate a floating of the front end of the medium, and also regulate an upper surface of the medium having a thickness and a rigidity.

The support member 109 is a member to support the brake roller 113, and a lower surface of the support member 109 forms a part of the upper guide 107*b*. The support member 109 is supported by the upper housing 102 so that an upstream end portion thereof swings upward (in a direction of an arrow A5 in FIG. 2).

The second guide 110 is provided between the feed roller 112 and the brake roller 113, and the first conveyance roller 114 and the second conveyance roller 115 in the medium conveying direction A1. The second guide 110 is supported by the upper housing 102 so that a downstream end portion thereof swings upward (in a direction of an arrow A6 in FIG. 2) according to the thickness of the conveyed medium. The second guide 110 is in contact with the front end of the medium entering a nip position of the first conveyance roller 114 and the second conveyance roller 115 to regulate the floating of the front end of the medium, and also regulate the upper surface of the medium having the thickness and the rigidity.

The medium sensor 111 is located on an upstream side of the feed roller 112 and the brake roller 113. The medium sensor 111 includes a contact detection sensor, and detects whether or not the medium is placed on the medium tray 103. The medium sensor 111 generates and outputs a medium signal whose signal value changes in a state where the medium is placed on the medium tray 103 and a state where it is not placed.

The feed roller 112 is provided on the lower housing 101 and sequentially feed media placed on the medium tray 103 from the lower side. The brake roller 113 is an example of a separation roller. The brake roller 113 is provided in the upper housing 102, and is located to face the feed roller 112 to separate the medium.

The first imaging device 116*a* includes a line sensor based on a unity-magnification optical system type contact image sensor (CIS) including an imaging element based on a complementary metal oxide semiconductor (CMOS) linearly located in a main scanning direction. Further, the first imaging device 116*a* includes a lens for forming an image on the imaging element, and an A/D converter for amplifying and analog-digital (A/D) converting an electric signal output from the imaging element. The first imaging device 116*a* generates and outputs an input image imaging a front side of a conveyed medium, in accordance with control from a processing circuit to be described later.

Similarly, the second imaging device 116*b* includes a line sensor based on a unity-magnification optical system type CIS including an imaging element based on a CMOS linearly located in a main scanning direction. Further, the second imaging device 116*b* includes a lens for forming an image on the imaging element, and an A/D converter for amplifying and A/D converting an electric signal output from the imaging element. The second imaging device 116*b* generates and outputs an input image imaging a back side of a conveyed medium, in accordance with control from a processing circuit to be described later.

Only either of the first imaging device 116*a* and the second imaging device 116*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs. Hereinafter, the first imaging device 116*a* and the second imaging device 116*b* may be collectively referred to as imaging device 116.

The second conveyance roller 115, the second imaging device 116*b* and the second ejection roller 118 is supported by the upper housing 102 so as to move upward according to the thickness of the conveyed medium.

A medium placed on the medium tray 103 is conveyed between the lower guide 107*a* and the upper guide 107*b* in the medium conveying direction A1 by the feed roller 112 rotating in a direction of an arrow A11 in FIG. 2, that is, a medium feeding direction. The medium conveying apparatus 100 has two operation modes: a separation mode in which the medium is separated and fed when a plurality of media is placed on the medium tray 103, and a non-separation mode in which a medium such as a passport is fed without separating. When operating in the separation mode, the brake roller 113 rotates in a direction of an arrow A12, that is, in a direction opposite to the medium feeding direction during conveying the medium. By the workings of the feed roller 112 and the brake roller 113, when a plurality of media are placed on the medium tray 103, only a medium in contact with the feed roller 112, out of the media placed on the medium tray 103, is separated. Consequently, conveyance of a medium other than the separated medium is restricted (prevention of multi-feed) On the other hand, when operating in the non-separation mode, the brake roller 113 rotates in an opposite direction of the arrow A12, that is, the medium feeding direction, during feeding the medium.

The medium is fed between the first conveyance roller 114 and the second conveyance roller 115 while being guided by the lower guide 107*a* and the upper guide 107*b*. The medium is fed between the first imaging device 116*a* and the second imaging device 116*b* by the first conveyance roller 114 and the second conveyance roller 115 rotating in directions of an arrow A13 and an arrow A14, respectively. The medium read by the imaging device 116 is ejected onto the ejection tray 104 by the first discharge roller 117 and the second discharge roller 118 rotating in directions of an arrow A15 and an arrow A16, respectively.

Figure 3:
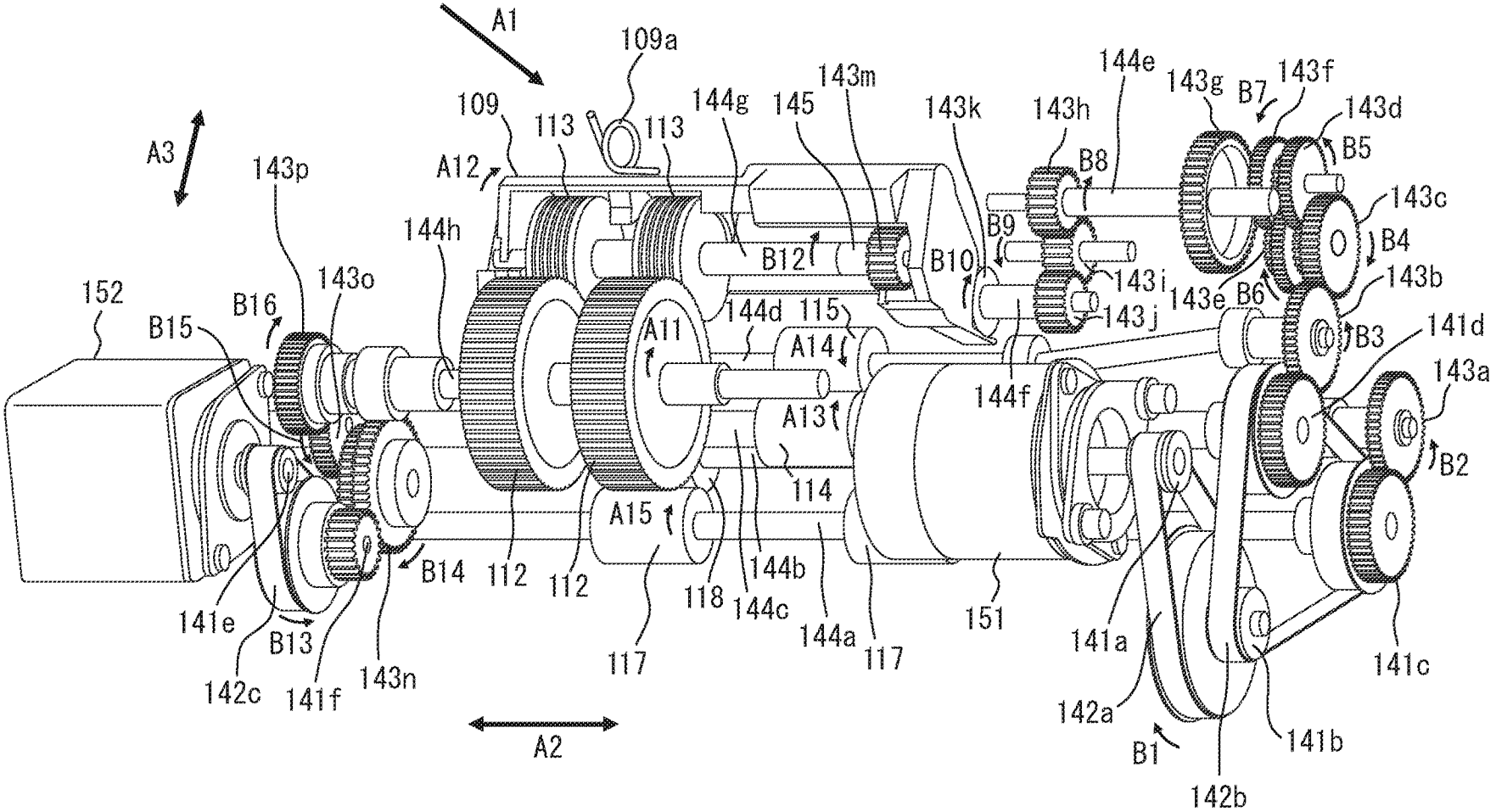
FIG. 3 is a schematic diagram for illustrating a driving mechanism of each roller.
Figure 4:
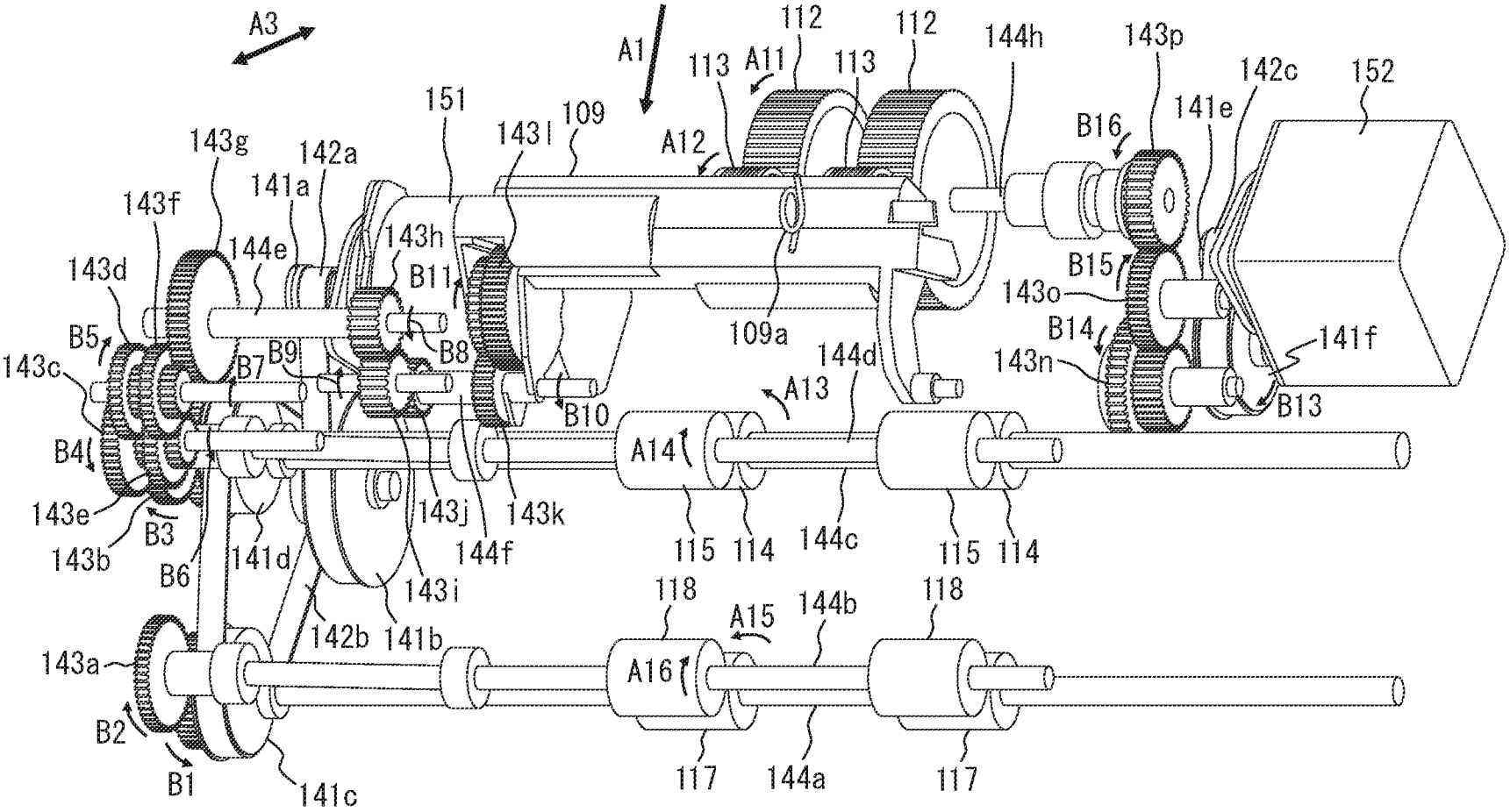
FIG. 4 is a schematic diagram for illustrating the driving mechanism of each roller.

FIG. 3 and FIG. 4 are schematic diagrams for illustrating a driving mechanism of the feed roller 112, the brake roller 113, the first conveyance roller 114, the second conveyance roller 115, the first ejection roller 117 and the second ejection roller 118. FIG. 3 is a perspective view of the driving mechanism of each roller as viewed from the upstream side. FIG. 4 is a perspective view of the driving mechanism of each roller as viewed from the above and downstream side.

As illustrated in FIG. 3 and FIG. 4, the driving mechanism of the brake roller 113, the first conveyance roller 114, the second conveyance roller 115, the first ejection roller 117 and the second ejection roller 118 includes a first motor 151, first to fourth pulleys 141*a* to 141*d*, first to second belts 142*a* to 142*b*, first to thirteenth transmission gears 143*a* to 143*m*, first to seventh shafts 144*a* to 144*g* and a torque limiter 145, etc. On the other hand, the driving mechanism of the feed roller 112 includes a second motor 152, fifth to sixth pulleys 141*e* to 141*f*, a third belt 142*c*, fourteenth to sixteenth transmission gears 143*n* to 143*p* and an eighth shaft 144*h*, etc.

The first motor 151 is an example of a motor, and generates a driving force for rotating the brake roller 113, the first conveyance roller 114, the second conveyance roller 115, the first ejection roller 117 and the second ejection roller 118 by a control signal from a processing circuit to be described later. The first motor 151 generates a first driving force for rotating the brake roller 113 in a direction A12 opposite to a medium feeding direction, and rotating the first conveyance roller 114, the second conveyance roller 115, the first ejection roller 117 and the second ejection roller 118 in the medium conveying directions A13 to A16. A part or all of the first conveyance roller 114, the second conveyance roller 115, the first ejection roller 117 and the second ejection roller 118 may be rotated by a driving force generated by the second motor 152 or other motor.

The first pulley 141*a* is attached to a rotation shaft of the first motor 151, and the first belt 142*a* is stretched between the first pulley 141*a* and a pulley portion having a larger outer diameter of the second pulley 141*b*. The second belt 142*b* is stretched between the pulley portion having the smaller outer diameter of the second pulley 141*b*, a pulley portion of the third pulley 141*c*, and a pulley portion of the fourth pulley 141*d*.

The third pulley 141*c* is attached to the first shaft 144*a*, and the first ejection roller 117 is further attached to the first shaft 144*a*. A gear portion of the third pulley 141*c* is engaged with the first transmission gear 143*a*. The first transmission gear 143*a* is attached to the second shaft 144*b* via a universal joint, and the second ejection roller 118 is further attached to the second shaft 144*b*. The fourth pulley 141*d* is attached to the third shaft 144*c*, and the first conveyance roller 114 is further attached to the third shaft 144*c*. A gear portion of the fourth pulley 141*d* is engaged with the second transmission gear 143*b*. The second transmission gear 143*b* is attached to the fourth shaft 144*d* via a universal joint, and the second conveyance roller 115 is further attached to the fourth shaft 144*d*.

The second transmission gear 143*b* is engaged with the third transmission gear 143*c*. The third transmission gear 143*c* is engaged with the fourth transmission gear 143*d*. The fourth transmission gear 143*d* is engaged with the fifth transmission gear 143*e*. The fifth transmission gear 143*e* is engaged with the sixth transmission gear 143*f*. The sixth transmission gear 143*f* is engaged with the seventh transmission gear 143*g*. The seventh transmission gear 143*g* is attached to the fifth shaft 144*e*, and the eighth transmission gear 143*h* is further attached to the fifth shaft 144*e*. The eighth transmission gear 143*h* is engaged with the ninth transmission gear 143*i*, and the ninth transmission gear 143*i* is engaged with the tenth transmission gear 143*j*. The tenth transmission gear 143*j* is attached to the sixth shaft 144*f*, and the eleventh transmission gear 143*k* is further attached to the sixth shaft 144*f*. The eleventh transmission gear 143*k* is engaged with the twelfth transmission gear 143*l*, and the twelfth transmission gear 143*l* is engaged with the thirteenth transmission gear 143*m*. The thirteenth transmission gear 143*m* is attached to the seventh shaft 144*g*, and the brake roller 113 is further attached to the seventh shaft 144*g*.

The torque limiter 145 is provided between the twelfth transmission gear 143*l* and the brake roller 113 on the seventh shaft 144*g* which is the rotation axis of the brake roller 113. That is, the torque limiter 145 is located on a driving force transmission path from the first motor 151 to the brake roller 113 to control a load applied to the brake roller 113. Since there is no gear row between the torque limiter 145 and the brake roller 113, it is suppressed that the separation force applied to the brake roller 113 fluctuates due to manufacturing errors, etc., for each part. Consequently, the medium conveying apparatus 100 can separate a medium with high precision regardless of a manufacturing error for each part.

A limit value of the torque limiter 145 is set to a value by which a rotational force through the torque limiter 145 is cut off when there is one medium, and the rotational force through the torque limiter 145 is transmitted when there are a plurality of media. Consequently, when only one medium is conveyed, the brake roller 113 do not rotate according to the first driving force and are driven by the feed roller 112. On the other hand, when a plurality of media are conveyed, the brake roller 113 prevents occurrence of multi-feed of the media by rotating in the direction A12 opposite to the medium feeding direction and separating a medium in contact with the feed rollers 112 from the other media. At this time, an outer peripheral surface of the brake roller 113 may be apply a force in the direction A12 opposite to the medium feeding direction to the media in a state in which the outer peripheral surface is not rotating in the direction A12 opposite to the medium feeding direction and is stopped.

The first to fourth pulleys 141*a* to 141*d*, the first to second belts 142*a* to 142*b*, the first to thirteenth transmission gears 143*a* to 143*m*, and/or the fifth to seventh shafts 144*e* to 144*g* are examples of transmission members to transmit the driving force generated by the first motor 151 to the torque limiter 145. The transmission member may be composed of only gears or only pulleys and belts.

The second motor 152 generates a driving force for rotating the feed roller 112 by a control signal from a processing circuit to be described later. The second motor 152 generates a second driving force for rotating the feed roller 112 in the medium feeding direction A11.

The fifth pulley 141*e* is attached to a rotation axis of the second motor 152, and the third belt 142*c* is stretched between the fifth pulley 141*e* and a pulley portion of the sixth pulley 141*f* A gear portion of the sixth pulley 141*f* is engaged with the fourteenth transmission gear 143*n*, the fourteenth transmission gear 143*n* is engaged with the fifteenth transmission gear 143*o*, and the fifteenth transmission gear 143*o* is engaged with the sixteenth transmission gear 143*p*. The sixteenth transmission gear 143*p* is attached to the eighth shaft 144*h*, and the feed roller 112 is further attached to the eighth shaft 144*h*.

One end of a spring 109*a* is supported by the upper housing 102, and the other end of the spring 109*a* is attached to an upper surface of the support member 109. The support member 109 and the brake roller 113 are urged by the spring 109*a* downward in the height direction A3, that is, toward the feed roller 112 side. The spring 109*a* is an example of a pressing member to press the brake roller 113 toward the feed roller 112 side. Instead of the spring 109*a*, rubber, etc., may be used as the pressing member. Hereinafter, the brake roller 113, the support member 109, the eleventh to thirteenth transmission gears 143*k* to 143*m*, the seventh shaft 144*g* and the torque limiter 145 may be collectively referred to as a brake roller unit. The brake roller unit is an example of a unit.

Hereinafter, the operations of each roller and the driving mechanism of each roller will be described.

When the first motor 151 generates the first driving force, the first pulley 141*a* rotates in a direction of an arrow B1, and the second to fourth pulleys 141*b* to 141*d* accordingly rotate in the direction of the arrow B1, respectively. Further, the first to seventh transmission gears 143*a* to 143*g* rotate in directions of arrows B2 to B8, respectively, the eighth to tenth transmission gears 143*h* to 143*j* rotate in directions of arrows B8 to B10, respectively, and the eleventh to thirteenth transmission gears 143*k* to 143*m* rotate in directions of the arrows B10 to B12, respectively. As a result, the brake roller 113 rotates together with the seventh shaft 144*g* which is the rotation axis, in the direction A12 opposite to the medium feeding direction by the first driving force from the first motor 151.

The eleventh transmission gear 143*k* is an example of a first gear, and rotates according to the first driving force generated by the first motor 151. The thirteenth transmission gear 143*m* is an example of a second gear, and is provided on the seventh shaft 144*g* which is the rotation axis of the brake roller 113. The twelfth transmission gear 143*l* is an example of a third gear, and is provided between the eleventh transmission gear 143*k* and the thirteenth transmission gear 143*m*.

The first ejection roller 117 rotates in the medium conveying direction A15 by the third pulley 141*c* rotating in the direction of the arrow B1. The second ejection roller 118 rotates in the medium conveying direction A16 by the first transmission gear 143*a* rotating in the direction of the arrow B2. The first conveyance roller 114 rotates in the medium conveying direction A13 by the fourth pulley 141*d* rotating in the direction of the arrow B1. The second conveyance roller 115 is rotated in the medium conveying direction A14 by the second transmission gear 143*b* rotating in the direction of arrow B3.

On the other hand, when the second motor 152 generates the second driving force, the fifth pulley 141*e* rotates in a direction of an arrow B13, and the sixth pulley 141*f* accordingly rotates in the direction of the arrow B13. Further, the feed roller 112 rotates in the medium feeding direction A11 by the fourteenth to sixteenth transmission gears 143*n* to 143*p* rotating in directions of arrows B14 to B16, respectively.

Figure 5:
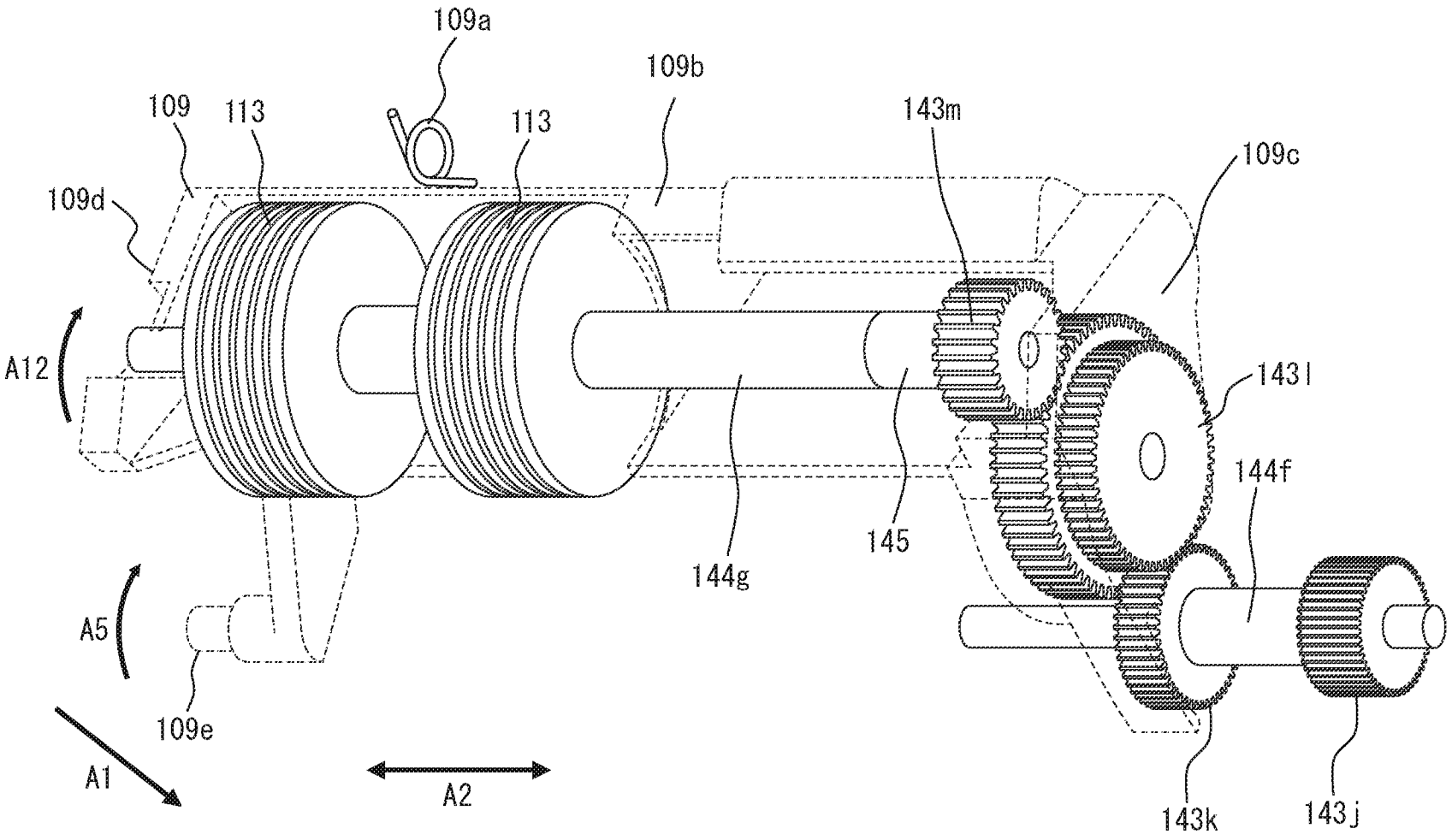
FIG. 5 is a schematic view for illustrating a support member 109.

FIG. 5 is a schematic view for illustrating the support member 109. FIG. 5 is a perspective view of a driving mechanism of the support member 109 and the brake roller 113 as viewed from the upstream side. In FIG. 5, the support member 109 is indicated by a dotted line.

The support member 109 is formed of a resin or metal, etc. The support member 109 has an upper surface 109*b*, a first side surface 109*c* and a second side surface 109*d*. The support member 109 supports the eleventh to thirteenth transmission gears 143*k* to 143*m*, the torque limiter 145 and the brake roller 113. The spring 109*a* described above, is attached to the upper surface 109*b*. The sixth shaft 144*f* to which the eleventh transmission gear 143*k* is attached and a shaft to which the twelfth transmission gear 143*l* is attached are attached to the first side surface 109*c*. Both ends of the seventh shaft 144*g* to which the thirteenth transmission gear 143*m*, the torque limiter 145 and the brake roller 113 are attached are attached to the first side surface 109*c* and the second side surface 109*d*. The second side surface 109*d* is provided with a projection 109*e* located coaxially with the sixth shaft 144*f*, and the support member 109 is attached to the upper housing 102 rotatably (swingably) with the projection 109*e* and the sixth shaft 144*f* as a rotation (swinging) axis.

In this manner, the support member 109 is supported swingably (rotatably) by the upper housing 102 with the sixth shaft 144*f* which is an axis of the eleventh transmission gear 143*k*, as a rotation axis, and supports the brake roller 113 swingably.

Figure 6:
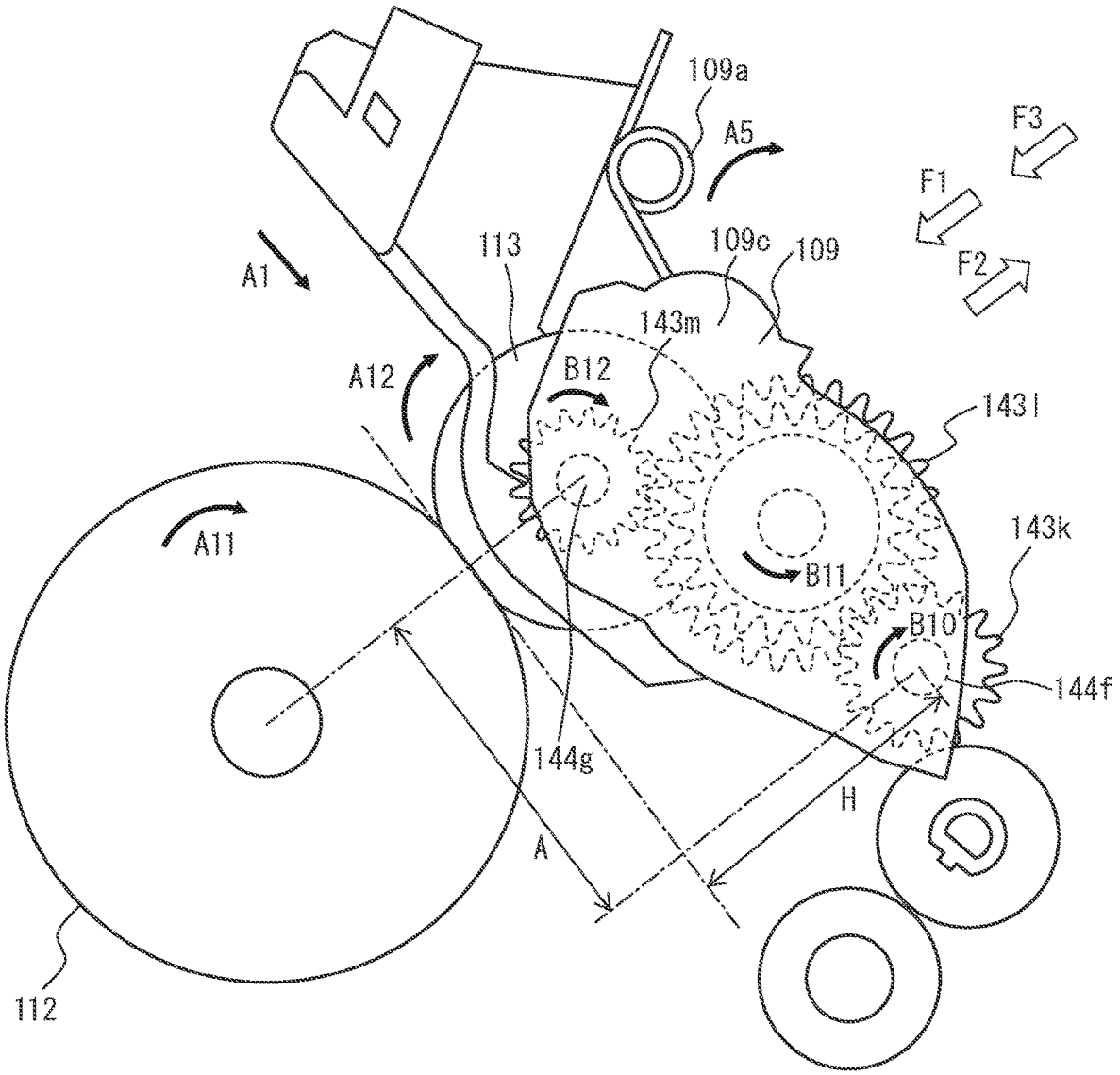
FIG. 6 is a schematic diagram for illustrating an operation of a brake roller 113, etc.

FIG. 6 is a schematic diagram for illustrating an operation of the eleventh to thirteenth transmission gears 143*k* to 143*m*, the support member 109 and the brake roller 113.

As described above, when the first motor 151 generates the first driving force, the eleventh to thirteenth transmitting gears 143*k* to 143*m* rotate in the directions of the arrows B10 to B12, respectively, and the brake roller 113 rotates in the direction A12 opposite to the medium feeding direction. Further, the eleventh to thirteenth transmission gears 143*k* to 143*m* and the brake roller 113 are supported by the support member 109 provided rotatably (swingably) about the sixth shaft 144*f* to which the eleventh transmission gear 143*k* is attached. Thus, a force directed in the direction of the arrow A5 is applied to the twelfth transmission gear 143*l* by the eleventh transmission gear 143*k* rotating in the direction of the arrow B10. Thereby, a force rotating about the sixth shaft 144*f* in the direction of the arrow A5 is applied to the first side surface 109*c* to which the twelfth transmission gear 143*l* is attached. As a result, a force that rotates about the sixth shaft 144*f* in the direction of the arrow A5 is applied to the support member 109, and a force is applied to the brake roller 113 in the direction that separates from the feed roller 112 in the direction of the arrow A5.

That is, the brake roller unit is supported swingably with respect to the sixth shaft 144*f* so that a predetermined force acts in a direction away from the feed roller 112 with respect to the brake roller 113 when the first driving force is transmitted from the eleventh to thirteenth transmission gears 143*k* to 143*m*. The eleventh transmission gear 143*k* rotates in a direction for generating a force for separating the brake roller 113 from the feed roller 112 (in the direction of the arrow B10), by the rotation of the first motor 151. The support member 109 and the brake roller 113 are pressed by the spring 109*a* toward the feed roller 112. Thus, the brake rollers 113 can feed the medium without separating from the feed rollers 112.

Hereinafter, the force acting on the brake rollers 113 will be described.

As illustrated in FIG. 6, the twelfth transmission gear 143*l* is a two-stage gear, and the number of teeth of a gear on the thirteenth transmission gear 143*m* side is more than the number of teeth of a gear on the eleventh transmission gear 143*k* side. That is, the twelfth transmission gear 143*l* operates as a reduction gear for decelerating and transmitting the rotation from the eleventh transmission gear 143*k* to the thirteenth transmission gear 143*m*. The twelfth transmission gear 143*l* decelerates and transmits the first driving force of the first motor 151 from the eleventh transmission gear 143*k* to the thirteenth transmission gear 143*m*. Each gear of the twelfth transmission gear 143*l* is formed of an integral member. Each gear of the twelfth transmission gear 143*l* may be formed integrally with a separate member.

First to third forces F1 to F3 act on the brake roller 113. The first force F1 is a force that causes the brake roller 113 to bite into the feed roller 112, and generated by a load (separation torque) toward the medium conveying direction A1 applied to the brake roller 113 which attempts to rotate in the direction A12 opposite to the medium feeding direction, wherein the force. That is, the first force F1 is generated by the torque limiter 145 limiting a torque with which the brake roller 113 attempts to rotate in the direction opposite to the rotation direction A12 of the feed roller 112. The first force F1 is a force for pressing the brake roller 113 toward the feed roller 112 side by the torque limiter 145. The brake roller 113 is pressed toward the feed roller 112 side by the first force F1.

The second force F2 is a force that attempts to float the brake roller 113 upward, and generated by a gear transmission torque of the gear group including the eleventh to thirteenth transmission gears 143*k* to 143*m*. That is, the second force F2 is a force for separating the brake roller 113 from the feed roller 112 by the eleventh transmission gear 143*k*.

The third force F3 is a pressing force by which the spring 109*a* presses the brake rollers 113 toward the feed rollers 112 side. The third force F3 is a static force determined according to the spring constant, etc., of the spring 109*a*. That is, the third force F3 is a force for pressing the brake roller 113 toward the feed roller 112 by the spring 109*a*.

In the brake roller 113, a force having a magnitude acquired by subtracting a magnitude of the second force F2 from the sum of a magnitude of the first force F1 and a magnitude of the third force F3 acts in a direction in which the brake roller 113 presses the feed roller 112. In order to separate two sheets, a separation force applied to the two sheets (a back load by the brake roller 113) needs to be larger than a frictional force between the two sheets. A magnitude of the separation force applied to the two sheets is calculated by dividing a limit value by the torque limiter 145 by a radius of the brake roller 113. On the other hand, a magnitude of the frictional force between the two sheets is calculated by multiplying a frictional coefficient between the two sheets by the above described force acting in the direction in which the brake roller 113 presses the feed roller 112. That is, as the force acting in the direction in which the brake roller 113 presses the feed roller 112 increases, the friction coefficient of separable papers decreases, and the multi-feed of the medium tends to occur.

For example, the second force F2 can be increased by sufficiently increasing the size (the number of teeth) of the eleventh transmission gear 143*k* which is a swinging axis of the brake roller 113. However, when the size of the eleventh transmission gear 143*k* is increased, the rotation fulcrum of the eleventh transmission gear 143*k* needs to be separated largely from the medium conveying path so that the eleventh transmission gear 143*k* does not project into the medium conveying path. As a distance between the rotation fulcrum of the eleventh transmission gear 143*k* and the medium conveying path increases, the first force F1 increases, and as a result, it is more difficult to reduce the force acting in the direction in which the brake roller 113 presses the feed roller 112.

The second force F2 can also be increased by sufficiently decreasing the size (the number of teeth) of the thirteenth transmission gear 143*m* attached to the seventh shaft 144*g* supporting the brake roller 113. However, when the size of the 13 transmission gear 143*m* is decreased, the tooth surface strength of the thirteenth transmission gear 143*m* is reduced, the thirteenth transmission gear 143*m* is easily worn, as a result, the device life (or component life) of the medium conveying apparatus 100 is shortened.

The medium conveying apparatus 100 uses a reduction gear as the twelfth transmission gear 143*l* which is an idler gear provided between the eleventh transmission gear 143*k* and the thirteenth transmission gear 143*m*. As a result, the medium conveying apparatus 100 can increase the second force F2 without sufficiently increasing the size of the eleventh transmission gear 143*k* or sufficiently decreasing the size of the thirteenth transmission gear 143*m*. As a result, the medium conveying apparatus 100 can reduce the force acting in the direction in which the brake roller 113 presses the feed roller 112, and thereby suppress the occurrence of multi-feed of the medium.

As described above, the third force F3 is a static force determined according to the spring constant of the spring 109*a*, etc. On the other hand, the first force F1 and the second force F2 are the dynamic forces generated with feeding and separating the media. Therefore, the first force F1 and the second force F2 varies slightly by a slight vibration due to unevenness formed on a surface (rubber) of the feed roller 112 and the brake roller 113, or the engagement timing of members inside the torque limiter 145. The smaller the magnitudes of the first force F1 and the second force F2 are, the more stable a pressing force applied to the brake roller 113 is, and the more stably the medium is separated. However, since the magnitudes of the first force F1 and the second force F2 are determined by the structure of the unit, it is difficult to reduce the magnitudes of the first force F1 and the second force F2 themselves.

However, when a difference between the magnitude of the first force F1 and the magnitude of the second force F2 is small, the first force F1 and the second force F2 are canceled out, the pressing force applied to the brake roller 113 is kept stable, and the medium is stably separated. Generally, the magnitude of the first force F1 generated by the separation torque is sufficiently larger than the magnitude of the second force F2 generated by the gear transmission torque. As described above, in the medium conveyance apparatus 100, the second force F2 can be sufficiently large to have substantially the same magnitude as the first force F1, by providing the reduction gear between the eleventh transmission gear 143*k* and the thirteenth transmission gear 143*m*.

The first force F1 varies according to a positional relationship between the nip position of the feed roller 112 and the brake roller 113, and the swing fulcrum of the brake roller 113. The first force F1 is calculated by the following equation (1).

$$F1 = \{(T/R) \times H\}/A \quad (1)$$

Where T is the limit value of the torque limiter 145. R is the radius of the brake roller 113. H is a distance between the nip position of the feed roller 112 and the brake roller 113, and the rotation center of the eleventh transmission gear 143*k* in a direction perpendicular to a nip surface of the feed roller 112 and the brake roller 113 (see FIG. 6). A is a distance between the nip position of the feed roller 112 and the brake roller 113, and the rotation center of the eleventh transmission gear 143*k* in a direction parallel to the nip surface of the feed roller 112 and the brake roller 113 (see FIG. 6).

On the other hand, the second force F2 varies according to a gear row located between the swing fulcrum of the brake roller 113 and the rotation fulcrum of the brake roller 113. The second force F2 is calculated by the following equation (2).

$$F2 = \{T \times (Z1/Z2) \times G\}/A \quad (2)$$

Where Z1 is the number of teeth of the eleventh transmission gear 143*k*. Z2 is the number of teeth of the 13 transmission gear 143*m*. G is a ratio of the number of teeth of the gear on the thirteenth transmission gear 143*m* side to the number of teeth of the gear on the eleventh transmission gear 143*k* side in the twelfth transmission gear 143*l*.

The twelfth transmission gear 143*l* is provided so that a difference between the first force F1 and the second force F2 is equal to or less than a predetermined value. The twelfth transmission gear 143*l* is provided so that the first force F1 is equal to or more than the second force F2 so that the brake roller 113 does not float above the feed roller 112. That is, a tooth ratio G of the twelfth transmission gear 143*l* is set so as to satisfy the following equation (3).

$$0 \le [\{(T/R) \times H\}/A] - [\{T \times (Z1/Z2) \times G\}/A] \le D \quad (3)$$

Where D is a predetermined value, for example, is set to 100 [gf] (0.98 [N]).

For example, when the limit value T of the torque limiter 145 is 500 [gfcm], the radius R of the brake roller 113 is 13.5 [mm], the distance H is 25.6 [mm], and the distance A is 31.1 [mm], the first force F1 is 304.8 [gf]. Further, when the number of teeth Z1 of the eleventh transmission gear 143*k* is 28, and the number of teeth Z2 of the thirteenth transmission gear 143*m* is 24, the second force F2 is 187.6×G [gf]. In this case, the tooth ratio G of the twelfth transmission gear 143*l* is set to 1.09 or more and 1.62 or less, so as to satisfy Equation (3). The tooth ratio G of the twelfth transmission gear 143*l* is preferably set to 1.05 or more and 1.80 or less, by adding a margin in consideration of a component tolerance, etc., of the medium conveying apparatus 100.

Figure 7:
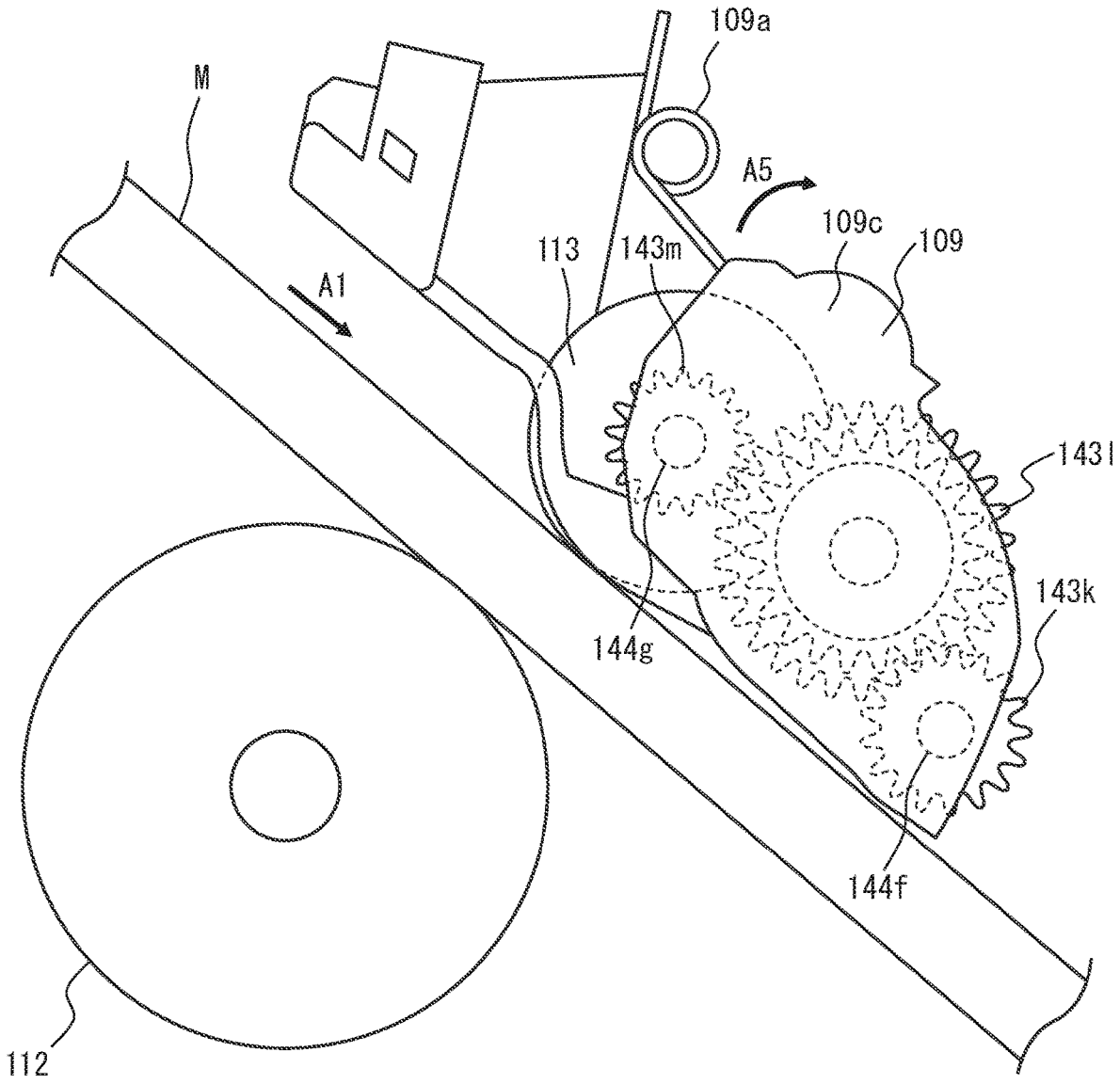
FIG. 7 is a schematic diagram for illustrating a state of the brake roller 113, etc.

FIG. 7 is a schematic diagram for illustrating a state of the brake roller 113 and the support member 109 when a medium having the thickness and the rigidity such as a passport is conveyed.

In the example illustrated in FIG. 7, a passport M is fed. As described above, the support member 109 is swingably supported by the upper housing 102. As illustrated in FIG. 7, since the passport M has the thickness and the rigidity, the brake roller 113 is pushed up by the passport M, and the seventh shaft 144*g* which is the rotation axis of the brake roller 113, is pushed up accordingly. Since the seventh shaft 144*g* is attached to the upstream end portion of the support member 109, and the downstream end portion of the support member 109 is swingably supported by the upper housing 102 with the sixth shaft 144*f* and the projection 109*e* as a swing axis, the support member 109 swings in the direction of the arrow A5.

Figure 8:
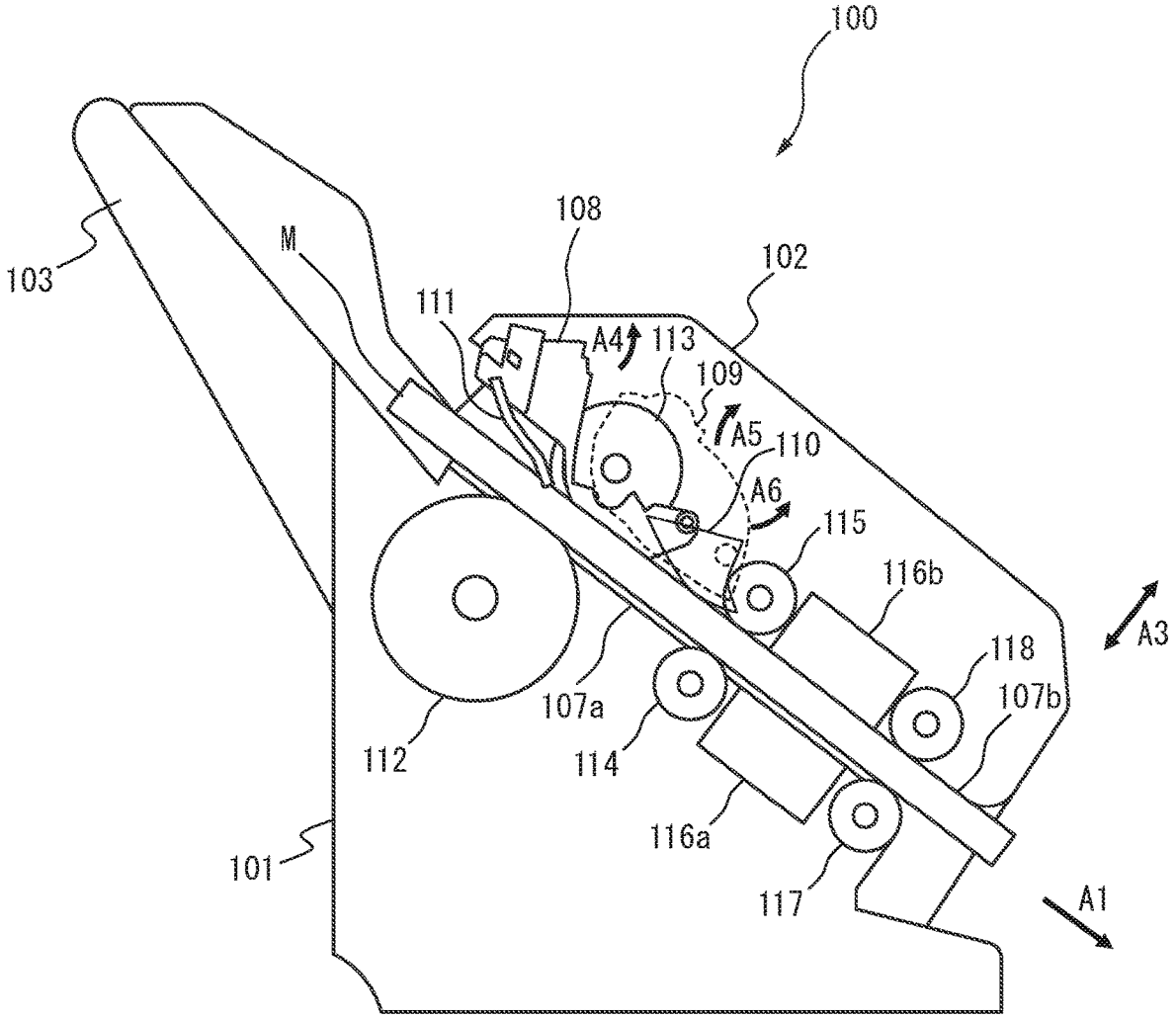
FIG. 8 is a schematic diagram for illustrating a state of an upper guide 107*b*, etc.

FIG. 8 is a schematic diagram for illustrating a state of the upper guide 107*b*, the second conveyance roller 115, the second imaging device 116*b* and the second ejection roller 118 when the medium having the thickness and the rigidity such as a passport is transported.

In the example shown in FIG. 8, the passport M is fed. As described above, the first guide 108 and the second guide 110 are swingably supported on the upper housing 102. As illustrated in FIG. 8, since the passport M has the thickness and the rigidity, the first guide 108 and the second guide 110 are pushed up by the passport M, swings in the direction of the directions of arrow A4 and A6, respectively. Further, as described above, since the second conveyance roller 115, the second imaging device 116*b* and the second ejection roller 118 are supported movably upward in the height direction A3 by the upper housing 102, they are pushed up by the passport M, and move upward.

In this manner, the lower guide 107*a* and the upper guide 107*b* are provided so as to be capable of conveying a passport. The brake roller unit including the brake roller 113, the support member 109, the eleventh to thirteenth transmission gear 143*k* to 143*m* and torque limiter 145 is located on the opposite side of the feed roller 112 with the lower guide 107*a* and the upper guide 107*b* in between. In order to reliably convey a passport having the thickness, the sixth shaft 144*f* which is a swinging shaft of the brake roller 113, is located at a position sufficiently apart from the lower guide 107*a*. For example, a distance between a center of the sixth shaft 144*f* and the lower guide 107*a* in the height direction A3 is set to 18 mm or more.

As described above, as the distance between the rotation fulcrum of the eleventh transmission gear 143*k* and the medium conveying path increases, the first force F1 increases. The medium conveying apparatus 100 increases the second force F2 by using the reduction gear as the twelfth transmission gear 143*l* which is the idler gear provided between the eleventh transmission gear 143*k* and the thirteenth transmission gear 143*m*. Thus, the medium conveying apparatus 100 can satisfactorily separate a plurality of media, such as papers, that are collectively conveyed, while suitably conveying a medium having the thickness, such as a passport. That is, the medium conveying apparatus 100 can achieve both the transportability of the medium having the thickness and the separability of the media conveyed collectively.

Figure 9:
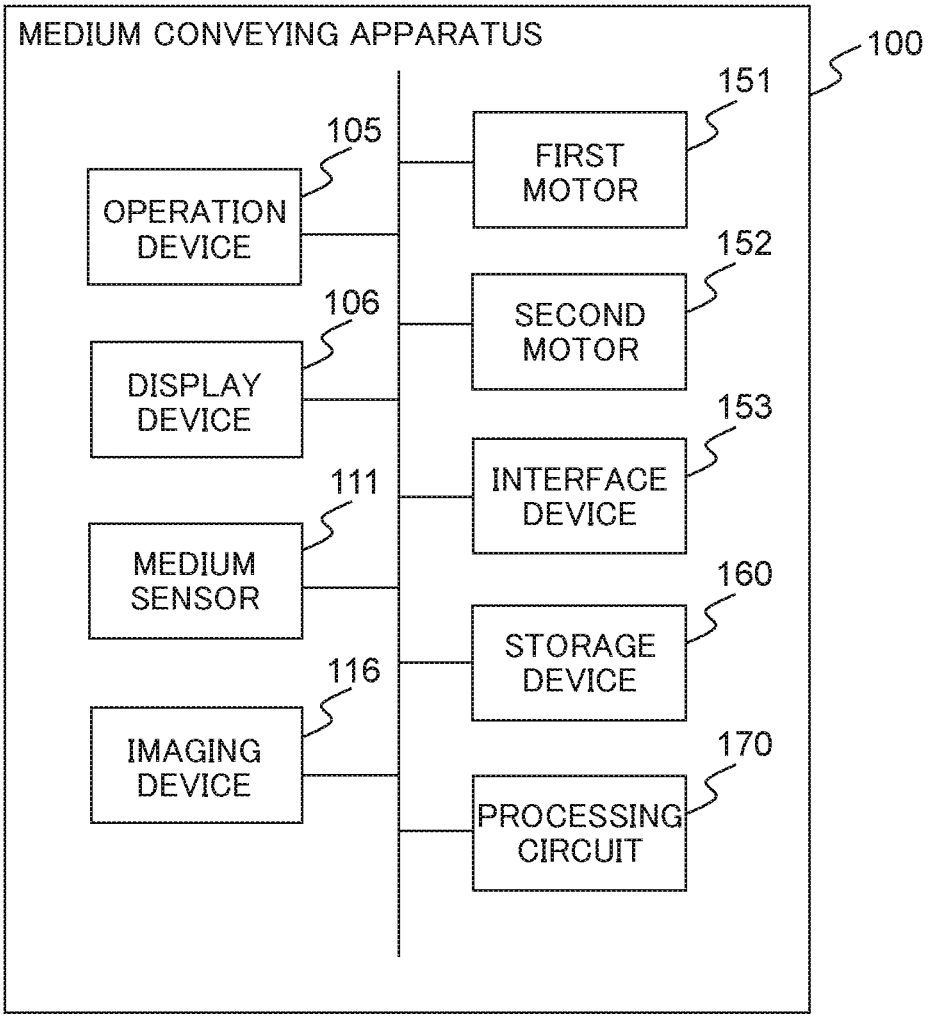
FIG. 9 is a block diagram illustrating a schematic configuration of the medium conveying apparatus 100.

FIG. 9 is a block diagram illustrating a schematic configuration of the medium conveying apparatus 100.

The medium conveying apparatus 100 further includes an interface device 153, a storage device 160 and a processing circuit 170, etc., in addition to the configuration described above.

For example, the interface device 153 includes an interface circuit conforming to a serial bus such as universal serial bus (USB), is electrically connected to an unillustrated information processing device (for example, a personal computer or a mobile information terminal), and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 153. For example, the predetermined communication protocol is a wireless local area network (LAN).

The storage device 160 includes a memory device such as a random access memory (RAM) or a read only memory (ROM), a fixed disk device such as a hard disk, or a portable storage device such as a flexible disk or an optical disk. Further, the storage device 160 stores a computer program, a database, a table, etc., used for various types of processing in the medium conveying apparatus 100. The computer program may be installed on the storage device 160 from a computer-readable, non-transitory medium such as a compact disc read only memory (CD-ROM), a digital versatile disc read only memory (DVD-ROM), etc., by using a well-known setup program, etc.

The processing circuit 170 operates in accordance with a program previously stored in the storage device 160. The processing circuit 170 is, for example, a CPU (Central Processing Unit). The processing circuit 170 may be a digital signal processor (DSP), a large scale integration (LSI), an application specific integrated circuit (ASIC), a field-programmable gate array (FPGA), etc.

The processing circuit 170 is connected to the operation device 105, the display device 106, the medium sensor 111, the imaging device 116, the first motor 151, the second motor 152, the interface device 153 and the storage device 160, etc., and controls each of these units. The processing circuit 170 performs drive control of the first motor 151 and the second motor 152, imaging control of the imaging device 116, etc., controls the conveyance of the medium, generates an input image, and transmits the input image to the information processing apparatus via the interface device 153.

Figure 10:
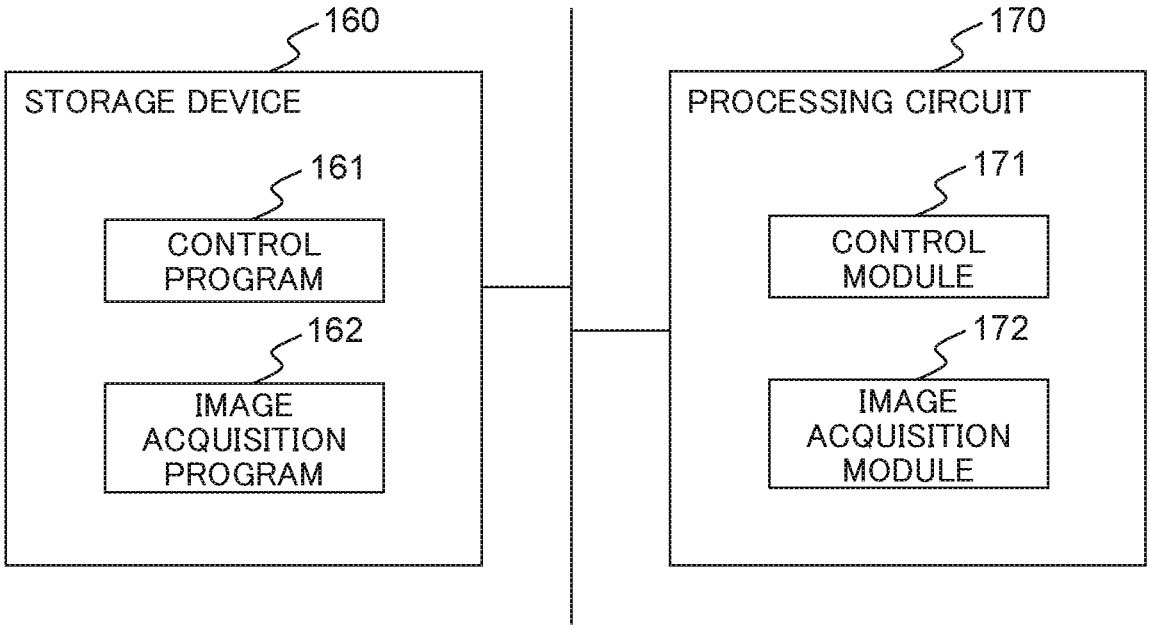
FIG. 10 is a diagram illustrating schematic configurations of a storage device 160 and a processing circuit 170.

FIG. 10 is a diagram illustrating schematic configurations of the storage device 160 and the processing circuit 170.

As illustrated in FIG. 10, a control program 161, an image acquisition program 162, etc., are stored in the storage device 160. Each of these programs is a functional module implemented by software operating on a processor. The processing circuit 170 reads each program stored in the storage device 160 and operates in accordance with each read program. Thus, the processing circuit 170 functions as a control module 171 and an image acquisition module 172.

Figure 11:
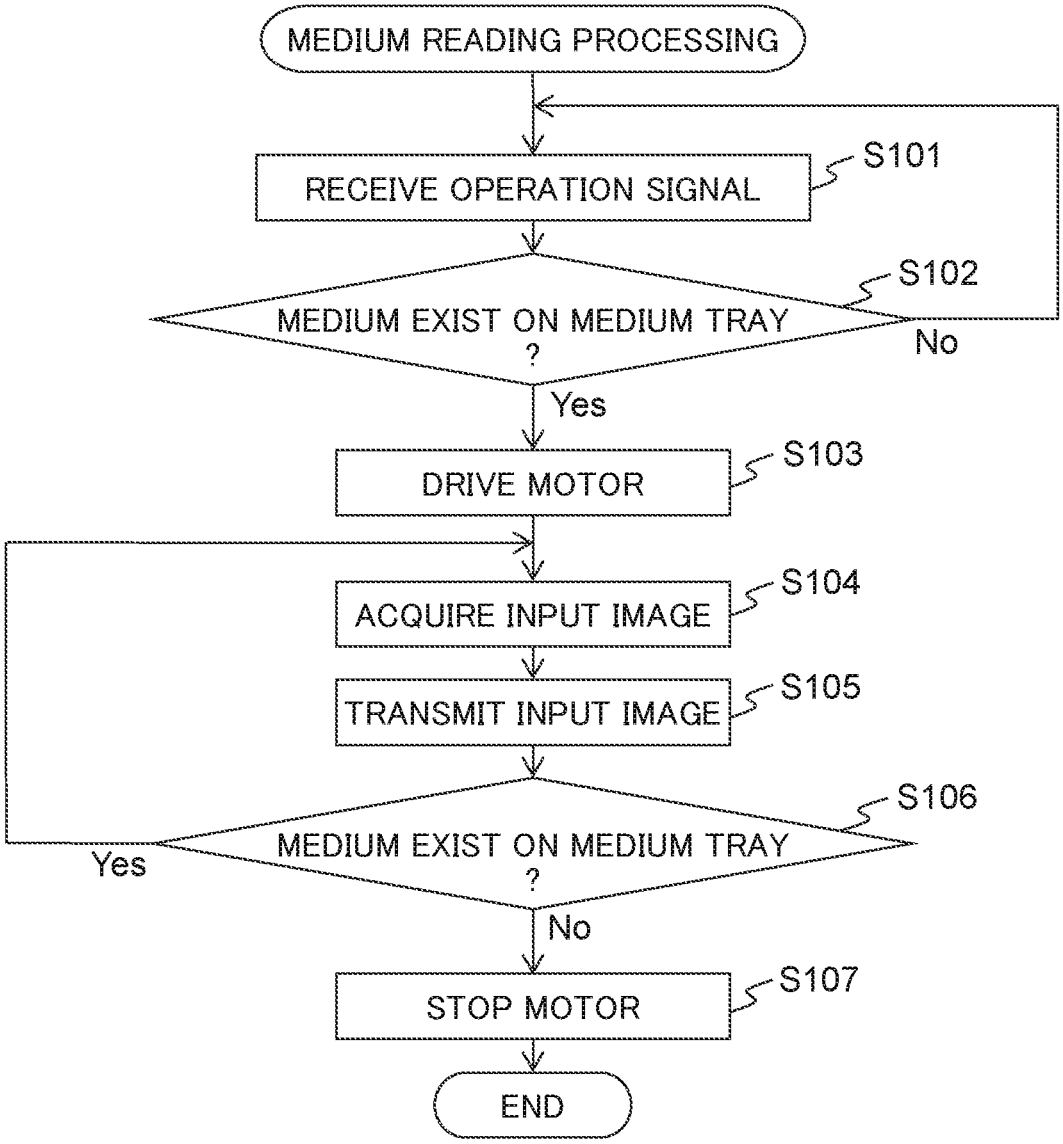
FIG. 11 is a flowchart illustrating an operation example of a medium reading processing.

FIG. 11 is a flowchart illustrating an operation example of the medium reading processing of the medium conveying apparatus 100.

Referring to the flowchart illustrated in FIG. 11, an operation example of the medium reading processing in the medium conveying apparatus 100 will be described below. The operation flow described below is executed mainly by the processing circuit 170 in cooperation with each element in the medium conveying apparatus 100, in accordance with a program previously stored in the storage device 160. The operation flow illustrated in FIG. 11 is periodically executed.

First, the control module 171 stands by until an instruction to read a medium is input by a user by use of the operation device 105, and an operation signal instructing to read the medium is received from the operation device 105 (step S101).

Next, the control module 171 acquires the medium signal from the medium sensor 111, and determines whether or not the medium is placed on the medium tray 103 based on the acquired medium signal (step S102).

When a medium is not placed on the medium tray 103, the control module 171 returns the processing to step S101 and stands by until newly receiving an operation signal from the operation device 105.

On the other hand, when a medium is placed on the medium tray 103, the control module 171 drives the first motor 151 and the second motor 152 (step S103). The control module 171 causes the first motor 151 to generate the first driving force. Thus, the control module 171 rotates the brake roller 113 in the direction A12 opposite to the medium feeding direction, and rotates the first conveyance roller 114, the second conveyance roller 115, the first ejection roller 117 and the second ejection roller 118 in the medium conveying directions A13 to A16. Further, the control module 171 causes the second motor 152 to generate the second driving force to rotate the feed rollers 112 in the medium feeding direction A11. Thus, the control module 171 performs feeding and conveying of the medium.

Next, the image acquiring module 172 causes the imaging device 116 to start imaging the medium, and acquires the input image from the imaging device 116 (step S104).

Next, the image acquisition module 172 transmits the input image to the information processing apparatus through the interface device 153 (step S105).

Next, the control module 171 determines whether or not a medium remains on the medium tray 103 based on the medium signal acquired from the medium sensor 111 (step S106). When a medium remains on the medium tray 103, the control module 171 returns the processing to step S104 and repeats the processing in steps S104 to S106.

On the other hand, when a medium does not remain on the medium tray 103, the control module 171 stops the first motor 151 and the second motor 152 (step S107), and ends the series of steps.

As described in detail above, in the medium conveying apparatus 100, the twelfth transmission gear 143*l* which is the reduction gear is provided between the eleventh transmission gear 143*k* and the thirteenth transmission gear 143*m*. Thus, the medium conveying apparatus 100 sets the separation force generated by the rotation of the eleventh transmission gear 143*k* to an appropriate value with respect to the pressing force generated by the torque limiter 145. Accordingly, the medium conveying apparatus 100 can apply an appropriate force to the medium when the medium is fed separately, and thereby can more appropriately separate and feed.

Figure 12:
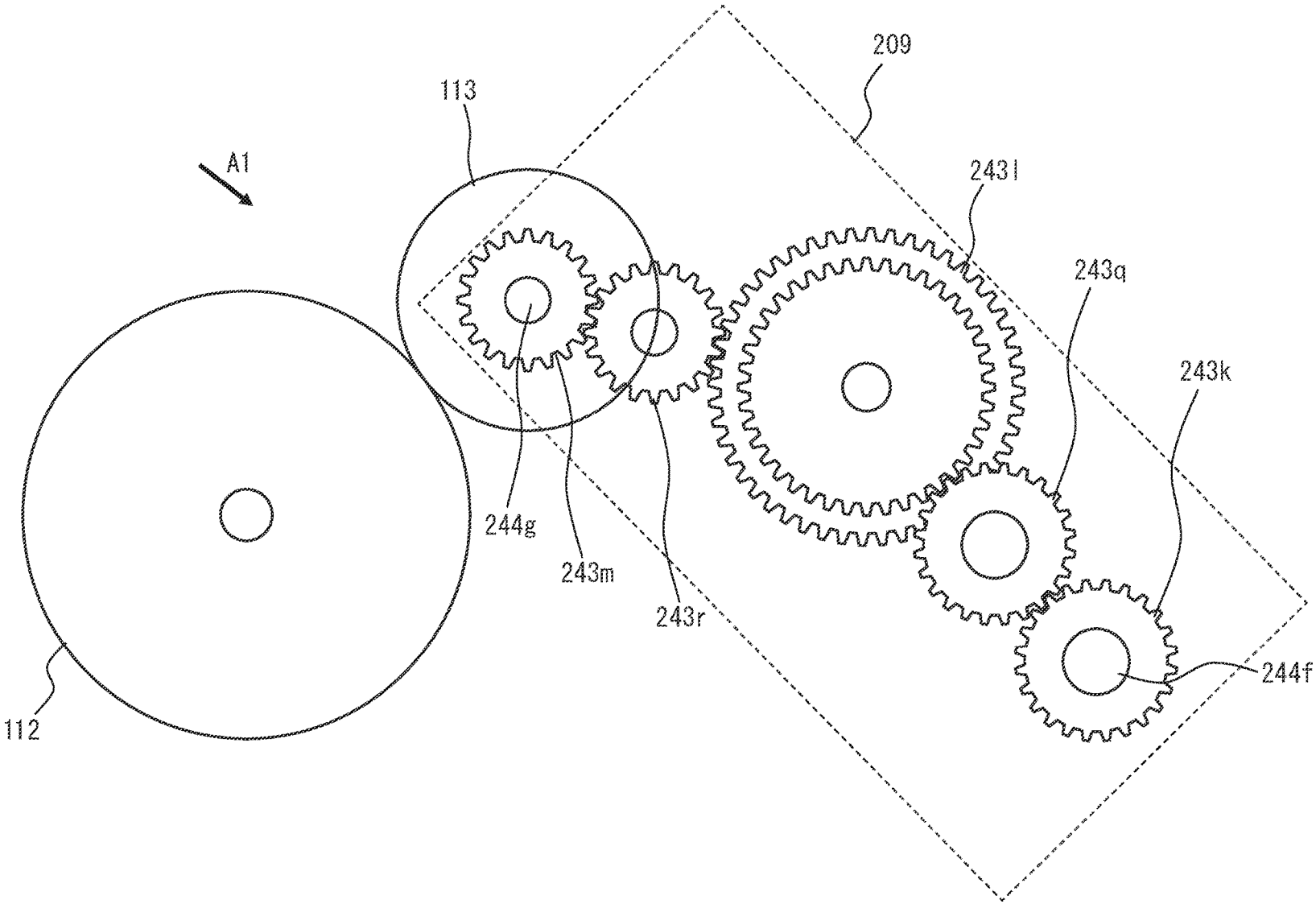
FIG. 12 is a schematic view for illustrating other gear group, etc.

FIG. 12 is a schematic diagram for illustrating a gear group in a medium conveying apparatus according to another embodiment.

In this embodiment, a support member 209 is used instead of the support member 109, and a sixth to seventh shafts 244*f* to 244*g* are used instead of the sixth to seventh shafts 144*f* to 144*g*. Further, the eleventh to thirteenth transmission gears 243*k* to 243*m* are used instead of the eleventh to thirteenth transmission gears 143*k* to 143*m*. A seventeenth transmission gear 243*q* is provided between the eleventh transmission gear 243*k* and the twelfth transmission gear 243*l*. An eighteenth transmission gear 243*r* is provided between the twelfth transmission gear 243*l* and the thirteenth transmission gear 243*m*. The support member 209, the sixth to seventh shafts 244*f* to 244*g* and the eleventh to thirteenth transmission gears 243*k* to 243*m* have the configuration similar to the support member 109, the sixth to seventh shafts 144*f* to 144*g* and the eleventh to thirteenth transmission gears 143*k* to 143*m*, respectively.

The seventeenth transmission gear 243*q* is attached to the support member 209 so as to engage with the eleventh transmission gear 243*k* and the twelfth transmission gear 243*l*. The eighteenth transmission gear 243*r* is attached to the support member 209 so as to engage with the twelfth transmission gear 243*l* and the thirteenth transmission gear 243*m*.

The number of gears located between the sixth shaft 244*f* which is a rotation axis of the eleventh transmission gear 243*k* and the seventh shaft 244*g* which is a rotation axis of the brake roller 113, is not limited to 3 or 5, and may be any odd number of 3 or more. As a result, a force is applied to the brake roller 113 in the same direction A5 as the rotation direction B10 of the eleventh transmission gear 243*k*, while the brake roller 113 rotates in the same direction A12 as the rotation direction B10 of the eleventh transmission gear 243*k*.

The twelfth transmission gear 243*l* which is a reduction gear, may be located at any position, such as a position where it engages with the eleventh transmission gear 243*k* or a position where it engages with the thirteenth transmission gear 243*m*. Thereby, the medium conveying apparatus can increase the second force F2 without sufficiently increasing the size of the eleventh transmission gear 243*k* or without sufficiently decreasing the size of the thirteenth transmission gear 243*m*.

As described in detail above, the medium conveying apparatus can more appropriately separate and feed the medium, even when the number of gears located between the rotation axis of the eleventh transmission gear 243*k* and the rotation axis of the brake roller 113 is an odd number of 5 or more.

Figure 13:
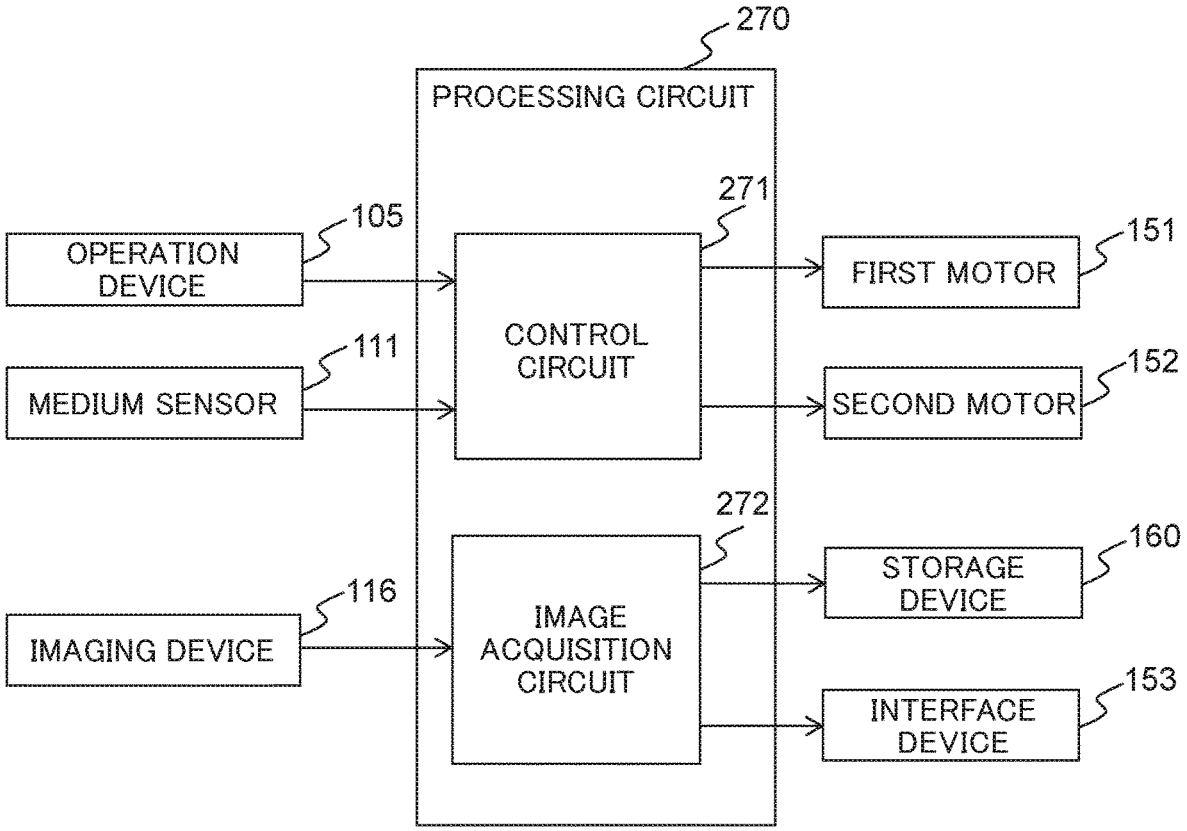
FIG. 13 is a diagram illustrating a schematic configuration of another processing circuit 270.

FIG. 13 is a diagram illustrating a schematic configuration of a processing circuit 270 in a medium conveying apparatus according to yet another embodiment. The processing circuit 270 is used in place of the processing circuit 170 in the medium conveying apparatus 100 and executes the medium reading processing and the setting processing in place of the processing circuit 170. Processing circuit 270 includes a control circuit 271 and an image acquisition circuit 272, etc. Note that each unit may be configured by an independent integrated circuit, a microprocessor, firmware, etc.

The control circuit 271 is an example of a control module and has a function similar to the control module 171. The control circuit 271 receives the operation signal from the operating device 105 and the media signal from the media sensor 111. The control circuit 271 drives the first motor 151 and the second motor 152 according to the received signal.

The image acquisition circuit 272 is an example of an image acquisition module and has a function similar to the image acquisition module 172. The image acquisition circuit 272 receives an input image from an imaging device 116 and stores the input image into a storage device 160, and also transmits the input image to an information processing device through an interface device 153.

As described in detail above, the medium conveying apparatus can more appropriately separate and feed the medium even when using the processing circuit 270.

According to embodiment, the medium conveying apparatus can more appropriately separate and feed the medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a feed roller to feed a medium;

a separation roller located to face the feed roller to separate the medium;

a torque limiter provided on a rotation axis of the separation roller;

a motor to generate a driving force for rotating the separation roller in a direction opposite to a medium feeding direction;

a unit including a first gear to rotate according to a driving force generated by the motor, a second gear provided on the rotation axis of the separation roller, and a third gear provided between the first gear and the second gear, wherein the unit is supported swingably with an axis of the first gear as a rotation axis, wherein the torque limiter limits a torque with which the separation roller attempts to rotate in a direction opposite to a rotation direction of the feed roller so that a pressing force is applied to the unit so that the separation roller is pressed toward a side of the feed roller, wherein the first gear rotates in a direction for generating a separation force for separating the separation roller from the feed roller by rotation of the motor, wherein the third gear is a two-stage gear, wherein a number of teeth of a gear on a second gear side of the third gear is more than the number of teeth of a gear on a first gear side of the third gear, and wherein a number of gears located between a rotation axis of the first gear and a rotation axis of the separation roller is an odd number.

2. The medium conveying apparatus according to claim 1, wherein the third gear is configured such that a difference between the pressing force for pressing the separation roller toward the side of the feed roller, and the separation force for separating the separation roller from the feed roller by the first gear is equal to or less than a predetermined value.

3. The medium conveying apparatus according to claim 1, further comprising a pressing member to press the separation roller toward the side of the feed roller.

4. The medium conveying apparatus according to claim 1, further comprising a conveyance guide capable of conveying a passport, wherein the unit is located on an opposite side of the feed roller with the conveyance guide in between.

* * * * *